US005106106A

United States Patent [19]

Brückner et al.

[11] Patent Number: 5,106,106

[45] Date of Patent: Apr. 21, 1992

[54] SEALING STRUCTURE FOR USE IN GUIDING MOLTEN METAL FROM A METALLURGICAL VESSEL AND A SEAL THEREOF

[75] Inventors: Raimund Brückner, Engenhahn; Hans Rothfuss, Taunusstein, both of Fed. Rep. of Germany

[73] Assignee: Didier-Werke AG, Wiesbaden, Fed. Rep. of Germany

[21] Appl. No.: 633,399

[22] Filed: Dec. 21, 1990

Related U.S. Application Data

[62] Division of Ser. No. 436,788, Nov. 15, 1989, abandoned.

[30] Foreign Application Priority Data

Nov. 17, 1988 [DE] Fed. Rep. of Germany ..... 3838903

[51] Int. Cl.[5] ..... B22D 41/08; F16J 9/14

[52] U.S. Cl. ..... 277/207 A; 277/216; 277/DIG. 6; 222/598

[58] Field of Search ..... 277/207 A, DIG. 2, 216, 277/217, 220, 224, 222; 251/310, 352; 137/625.32; 222/598, 599, 606, 607

[56] References Cited

U.S. PATENT DOCUMENTS

| | | | |
|---|---|---|---|
| Re. 33,036 | 8/1989 | Schiefer et al. | 222/606 |
| 2,314,386 | 3/1943 | Brend | 277/207 A |
| 2,470,883 | 5/1949 | Boissou | 277/207 A |
| 2,631,002 | 3/1953 | Mueller | 251/310 |
| 3,058,752 | 10/1962 | Miller | 277/207 A |
| 3,556,360 | 1/1971 | Stelson | 222/598 |
| 3,561,487 | 2/1971 | Reed, Jr. | 137/625.32 |
| 3,651,998 | 3/1972 | Rocher | 222/598 |
| 4,047,743 | 9/1977 | Weintraub et al. | 277/207 A |
| 4,268,046 | 5/1981 | Nisper | 277/216 |
| 4,275,868 | 6/1981 | Crone | 251/310 |
| 4,522,415 | 6/1985 | Dworak et al. | 277/DIG. 6 |
| 4,704,332 | 11/1987 | Brennan et al. | 277/96 |
| 4,747,602 | 5/1988 | Kobayashi | 277/216 |
| 4,854,487 | 8/1989 | Ando et al. | 222/606 |
| 4,905,876 | 3/1990 | Gimpera | 222/598 |

*Primary Examiner*—William A. Cuchlinski, Jr.
*Assistant Examiner*—Daniel G. DePumpo
*Attorney, Agent, or Firm*—Wenderoth, Lind & Ponack

[57] ABSTRACT

The present invention is drawn to sealing structure for use in guiding molten metal from a metallurgical vessel and the seal thereof. The sealing structure includes first and second generally tubular refractory components one of which extends coaxially within the other with a clearance established therebetween. One of the components also has an annular groove therein confronting the other component at a sealing location. An open-ended elastically deformable spring ring is disposed in the annular groove and is self-biased into sealing engagement with a surface of the component that the annular groove confronts. The spring ring has a semi-annular main body and overlapped end portions extending from the main body.

20 Claims, 1 Drawing Sheet

SEALING STRUCTURE FOR USE IN GUIDING MOLTEN METAL FROM A METALLURGICAL VESSEL AND A SEAL THEREOF

This application is a division of now abandoned application Ser. No. 436,788 filed on Nov. 15, 1989.

BACKGROUND OF THE INVENTION

The present invention relates to a seal between refractory components which guide molten metal from a metallurgical vessel, and in particular, to a seal between two intercooperating tubular components that are employed at the pouring spout of a metallurgical vessel and are individually replaceable.

Typically, such components, which may constitute a pouring pipe, for example, are coaxially connected in a concentric overlapped manner at the outlet of a discharge valve for discharging molten metal from a metallurgical vessel. A seal is established between the components by a flexible, elastically yielding face seal. The components generally have conical or cylindrical complementary surfaces fitted loosely over one another, and between which a seal is to be established under the pressure generated at the outlet during the discharge of molten metal therethrough. The seal created by such pressure is not satisfactory because the components subjected to high temperature do not withstand the pressure well and become distorted to the degree that air manages to penetrate the seal established between the complementary surfaces and enters the stream of molten metal, such as steel. Such an introduction of air into the stream of molten metal, for example, causes the steel to be reoxidized. Similar problems occur at the sealed joints of refractory pipe components which guide molten metal from the spout of a metallurgical vessel to the nozzle of a horizontal continuous casting system.

Furthermore, in discharge valves which regulate the flow of molten metal from a metallurgical vessel, and which comprise two concentrically arranged pipes each having through-holes extending radially therethrough and movable relative to one another to move the through-holes into and out of alignment with one another, it is difficult to establish an effective seal between the pipes which allows one or both of the pipes to be rotated or adjusted longitudinally without any complications arising. On the one hand, the loose fit should be designed to prevent the molten metal from penetrating between the pipes; on the other hand, however, the pipes having different degrees of thermal expansion should not jam during operation.

SUMMARY OF THE INVENTION

An object of the present invention is to provide an effective seal between intercooperating molten metal-guiding components which eliminates the problems discussed above.

To achieve the above object, the sealing structure according to the present invention comprises first and second components, one of said components extending within the other and one of said components having an annular groove therein at a sealing location defined in the structure, and an elastically deformable spring ring disposed in the annular groove. The spring ring has overlapping end portions and is self-biased due to elastic characteristics thereof into sealing engagement with the tubular component which the annular groove confronts. With such structure, the loose fit or clearance between the two components is effectively sealed to the flow of media such that a stream of molten metal flowing through the components cannot suck air into the molten metal nor can the molten metal penetrate the seal. In addition, if necessary, the loose fit between the components can be established to a degree which allows the components to be readily adjusted with respect to one another during a discharge operation.

The seal, according to the present invention, is in the form of an elastic spring ring having a rectangular cross section and overlapped end portions, and is fitted in an annular groove extending in one of the components. The annular groove also has a rectangular cross section. The spring ring produces an excellent sealing effect which can be increased by employing several of such spring rings spaced apart from one another.

To further enhance the effectiveness of the seal, a passageway may be provided through the outer one of the components and open to an inner peripheral surface thereof at a location between two of the spaced apart annular grooves in which spring rings are disposed, whereby a sealing and/or cooling medium such as inert gas may be introduced under pressure between two adjacent spring rings.

In addition, a sealing surface of one of the components and the surface of the spring ring engaged therewith may be precision machined.

Finally, the spring ring preferably comprises a dense ceramic material, such as a ceramic oxide material and, in particular, zirconium oxide.

DETAILED DESCRIPTION OF THE PREFERRED EMBODIMENTS

Figure 1:
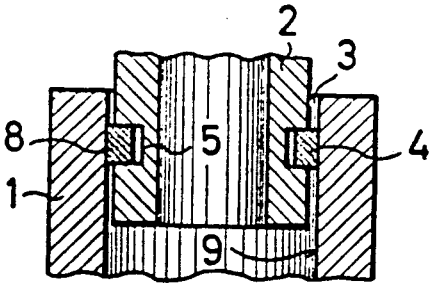
FIG. 1 is a vertical sectional view of sealing structure according to a first embodiment of the present invention.

In the figures, reference numerals 1 and 2 denote first and second tubular innercooperating refractory components through which molten metal is guided. The first and second components 1, 2 are loosely fitted to one another so as to define a clearance 3 therebetween. A seal is established between the first and second components in a manner which, if desired, allows the components to be moved relative to one another during, for example, a molten metal discharge operation.

Figure 2:
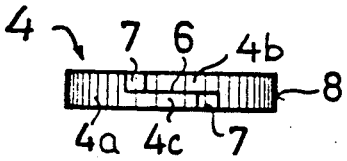
FIG. 2 is a side view of the spring ring shown in FIG. 1, according to the present invention.
Figure 3:
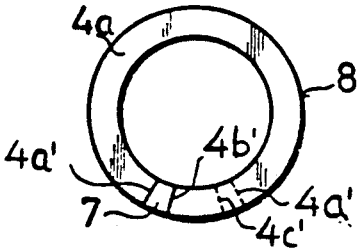
FIG. 3 is a top view of the spring ring shown in FIG. 2.

Referring now in particular to FIGS. 1-3, the seal between the refractory components 1, 2 is established by an open-ended elastically deformable ceramic spring ring 4. In the embodiment of FIGS. 1-3, the inner component 2 has an annular groove therein confronting component 1, and the ceramic spring ring 4 is disposed in the annular groove 5 and is self-biased in a radial direction due to the elasticity thereof into sealing engagement with a sealing surface of the component 1.

The spring ring 4, as shown in FIG. 1, has a rectangular cross section complementary to the rectangular cross section of the annular groove 5. As shown in FIGS. 2 and 3, the spring ring 4 has a semi-annular main body 4*a* and end portions 4*b*, 4*c*. The end portion 4*b*, for example, extends integrally from one end 4*a*' of the semi-annular main body 4*a* to a free end 4*b*' of the spring ring facing the other end 4*a*' of the main body 4*a* whereas the end portion 4*c* extends from said other end 4*a*' of the main body 4*a* to a free end 4*c*' of the spring ring, the end portions 4*b*, 4*c* being overlapped at the location designated by reference numeral 6. The overlap is provided in such a manner that spaces 7 are defined between the free ends 4*b*', 4*c*' of the spring ring and the respective ends 4*a*', 4*a*' of the semi-annular main body 4*a* of the spring ring.

Furthermore, the spring ring 4 is preferably formed of a dense ceramic material, and in particular, zirconium oxide.

In the embodiment of FIG. 1, the spring ring 4 is disposed in annular groove 5 in a state in which it is compressed radially inwardly so as to be self-biased into sealing contact with the inner peripheral surface 9 of the component 1 at a sealing location. Thus, a seal is established at the clearance 3 between the first and second components 1, 2.

To enhance the sealing effect, the outer peripheral sealing surface 8 of the spring ring 4 and the inner peripheral surface 9 of the outer component 1 can be precision machined. More specifically, the inner peripheral surface 9 may be, at a minimum, precision machined from the location of the seal to the open end thereof in order to facilitate the assembly and disassembly of the sealing structure.

As is evident from the discussion above with reference to FIGS. 2 and 3, the spring ring 4 is analogous to a piston ring and defines open spaces 7 when in a relaxed state but which spaces close to a degree that is proportional to the load exerted on the spring ring 4 in an inward radial direction.

Figure 4:
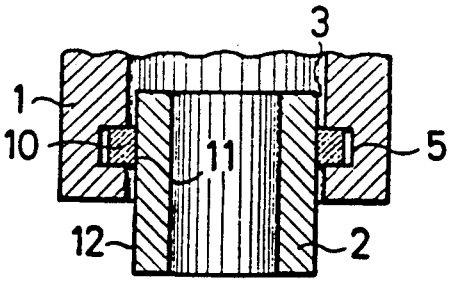
FIGS. 4 and 5 are vertical sectional views of other embodiments of sealing structure according to the present invention.

On the other hand, in the embodiment shown in FIG. 4, an open-ended elastically deformable ceramic spring ring 10 is provided in which the spaces 7 are closed when the spring ring 10 is in a relaxed state. Thus, with such a spring ring disposed in the annular groove 5 defined in the outer component 1, the spring ring 10 is self-biased so as to place the inner peripheral sealing surface 11 thereof into sealing engagement with the outer peripheral surface 12 of the inner component 2. Thus, in the loaded state, the spring ring 10 assumes a position similar to that shown in FIG. 2.

Figure 5:
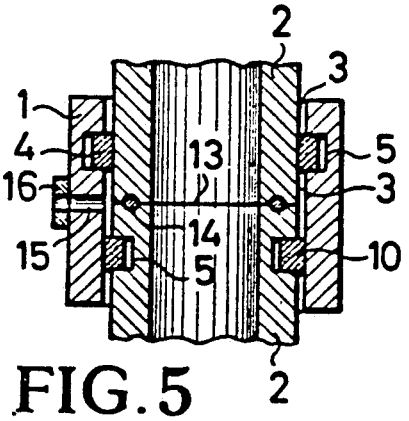

The sealing structure of the embodiment of FIG. 5 employs both the spring ring of the embodiment of FIG. 1 and the spring ring 10 of the embodiment of FIG. 4, such spring rings being respectively disposed in annular grooves 5 which are spaced apart from one another. Furthermore, the spring rings 4, 10 are disposed on respective sides of a joint 13 between two inner components 2. The joint 13 is sealed with an elastic seal 14 and is encircled by the outer component 1. The outer component 1 has a passageway extending therethrough and open to the inner peripheral surface thereof at a location between the spaced apart annular grooves 5 so as to allow, for example, a sealing gas to be fed therethrough into the clearance 3 between the spring rings 4, 10 to enhance the sealing effect. Such structure employing the fluid passageway 16 is particularly applicable in horizontal continuous casting systems in order to prevent air from being introduced into the stream of molten metal flowing through the inner components 2.

Figure 6:
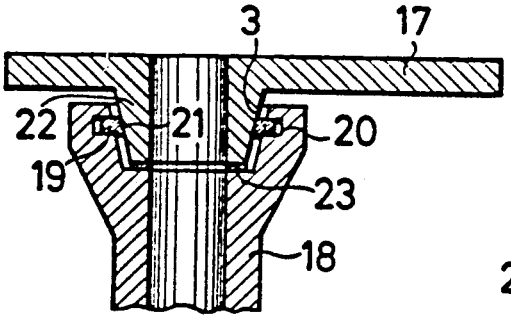
FIG. 6 is a vertical sectional view of sealing structure according to yet another embodiment of the present invention.
Figure 7:
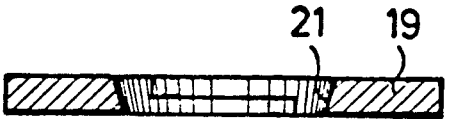
FIG. 7 is an enlarged sectional view of the spring ring shown in FIG. 6, according to the present invention.

In the embodiment shown in FIG. 6, the generally tubular first component 17 comprises an underplate of a slide gate nozzle having a tapered connecting cone 22. The second component 18 in the form of a discharge pipe is loosely connected to the first component 17 with a clearance 3 therebetween. A spring ring 19 is disposed within an annular groove 20 in component 18 with the inner peripheral sealing surface 21 of the spring ring 19 being in sealing engagement with the connecting cone 22. The spring ring 19, as shown in FIG. 7, is substantially closed when in a relaxed state and so is loaded when disposed around the connecting cone 22 in annular groove 20 so as to be self-biased into sealing engagement with the connecting cone 22. The inner peripheral surface 21 of the spring ring 19 is frusto-conical so as to be complementary to the outer peripheral surface of the tapered connecting cone 22. In FIG. 6, reference numeral 23 designates an elastic seal being provided between opposing planar surfaces of the connecting cone 22 and the second component 18.

Figure 8:
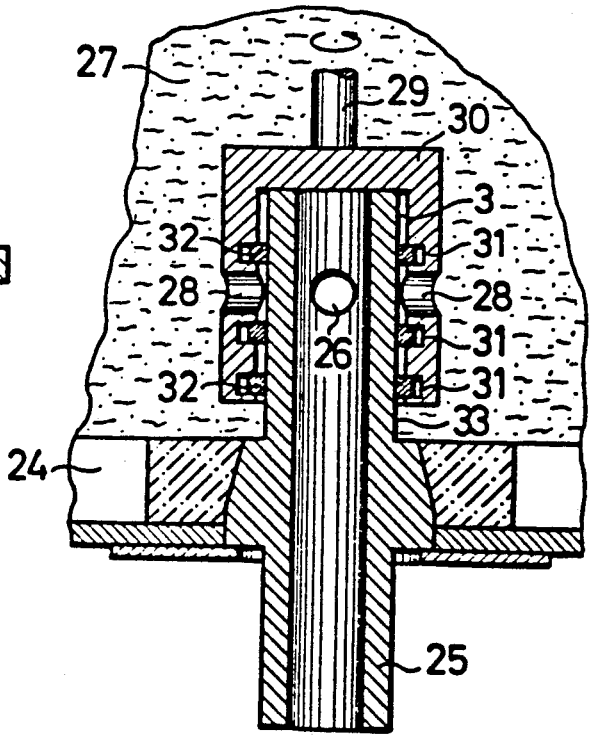
FIG. 8 is a vertical sectional view of sealing structure according to yet another embodiment of the present invention.

FIG. 8 shows sealing structure associated with a discharge valve for discharging molten metal from metallurgical vessels, according to the present invention. In this embodiment, the first component 25 is a spout that extends vertically into the metallurgical vessel from the bottom 24 thereof. The spout is fixed relative to the vessel and has through-holes 26 extending therethrough. The second component 30 is a rotary outer valve part that is disposed over the spout 25 and has through-holes 28 extending radially therethrough and a plurality of annular grooves 31 confronting the outer peripheral surface 33 of the spout. By rotating the component 30 relative to the component 25, the through-holes 26, 28 may be placed into alignment with one another such that molten metal 27 is discharged from the metallurgical vessel through the spout. It should be noted that the clearance 3 defined between the components 25, 30 allows the component 30 to be rotated relative to component 25 during the discharge operation at which the components are subjected to high temperatures and are expanded to degrees corresponding to the respective coefficients of thermal expansion thereof.

A plurality of spring rings 32 are disposed within the annular grooves 31, respectively, in sealing engagement with the outer peripheral surface 33 of component 25 so as to prevent molten metal from entering the clearance 3 established between the components 25, 30. Each of the spring rings 32 has essentially the same structure as the spring ring of the embodiment of FIGS. 1-3. And, the spring rings 32 not only serve to establish a seal between components 25, 30, but also serve as a guide for guiding the outer component 30 when rotated about axially extending shaft 29 relative to component 25 during the regulation of the flow of molten metal 27 from the metallurgical vessel.

Although the present invention has been described with reference to preferred embodiments thereof, various changes and modifications of the described invention will become apparent to those of ordinary skill in the art. Therefore, such changes and modifications are seen to be within the true spirit and scope of the invention as defined in the appended claims.

What is claimed is:

1. Sealing structure for use in guiding molten metal from a metallurgical vessel, said structure comprising:

first and second generally tubular refractory components, one of said components extending axially within the other with a loose fit or clearance therebetween, and said components defining a plurality of axially spaced annular grooves therein, each of said grooves extending in a respective one of said components and confronting the other of said components at a sealing location; and sealing means for sealing the loose fit or clearance such that a stream of molten metal flowing through the components cannot suck air into the molten metal through said sealing location nor can molten metal penetrate the sealing means at said sealing location, said sealing means comprising a plurality of elastically deformable spring rings of dense ceramic material respectively disposed in said annular grooves, each of said spring rings self-biased due to elastic characteristics thereof into sealing engagement with a surface of the component that the annular groove in which the spring ring is disposed confronts, and each of said spring rings having a semi-annular main body and end portions each of which extends integrally from one end of said semi-annular main body, respectively, toward a free end of the spring ring facing the other end of said main body, said end portions being overlapped.

2. Sealing structure as claimed in claim 1, wherein the outer one of said components has a passageway extending therethrough and open to the inner peripheral surface thereof at a location between two of the spaced apart annular grooves.

3. Sealing structure as claimed in claim 1, wherein one of said plurality of annular grooves extends in said first component and another of said annular grooves extends in said second component.

4. Sealing structure as claimed in claim 1, wherein said one of said components comprises two tubular inner members abutting end-to-end so as to form a joint therebetween, and two of the spaced apart annular grooves are located on opposite axial sides of said joint.

5. Sealing structure as claimed in claim 4, and further comprising an elastic seal interposed between the ends of said tubular inner members.

6. Sealing structure as claimed in claim 4, wherein the outer one of said components has a periphery extending therethrough and open to the inner peripheral surface thereof at a location between said two of the spaced apart annular grooves.

7. Sealing structure as claimed in claim 5, wherein the outer one of said components has a passageway extending therethrough and open to the inner peripheral surface thereof at a location between said two of the spaced apart annular grooves.

8. Sealing structure as claimed in claim 1, wherein said one of said components has at least one through-hole extending radially therethrough so as to be open to the interior thereof, the other of said components has at least one through-hole extending radially therethrough, said components being rotatable relative to one another between positions at which the at least one through-holes of said components are respectively in and out of alignment with one another, and wherein two of the spaced apart annular grooves are disposed on opposite axial sides of said at least one through-holes.

9. The combination of metallurgical vessel for accommodating a supply of molten metal, and a guide connected to said vessel for guiding molten metal from said vessel, said guide including first and second generally tubular components, one of said components extending coaxially within the other with a loose fit or clearance therebetween, said components defining a guide passage therethrough along which molten metal is dischargeable from said vessel, and one of said components having an annular groove therein confronting the other of said components at a sealing location, and sealing means for sealing the loose fit or clearance such that a stream of molten metal flowing through the components cannot suck air into the molten metal through said sealing location nor can molten metal penetrate the sealing means at said sealing location, said sealing means comprising an elastically deformable spring ring of dense ceramic material disposed in said annular groove and self-biased due to elastic characteristics thereof into sealing engagement with a surface of the component that said annular groove confronts at the sealing location, said spring ring having a semi-annular main body and end portions each of which extends integrally from one end of said semi-annular main body, respectively, toward a free end of the spring ring facing the other end of said main body, said end portions being overlapped.

10. The combination as claimed in claim 9, wherein said annular groove is disposed in the inner one of said components.

11. The combination as claimed in claim 9, wherein said annular groove is disposed in the outer end of said components.

12. The combination as claimed in claim 9, wherein said annular groove and said spring ring each have a rectangular cross section.

13. The combination as claimed in claim 9, wherein spaced from said annular groove is at least one other said annular groove and a respective said spring ring disposed therein.

14. The combination as claimed in claim 13, wherein the outer one of said components has a passageway extending therethrough and open to the inner peripheral surface thereof at a location between two of the spaced apart annular grooves.

15. The combination as claimed in claim 14, wherein said one of said components comprises two tubular inner members abutting end-to-end so as to form a joint therebetween, and two of the spaced apart annular grooves are located on opposite axial sides of said joint.

16. The combination as claimed in claim 15, and further comprising an elastic seal interposed between the ends of said tubular inner members.

17. The combination as claimed in claim 13, wherein one of said plurality of annular grooves extends in said first component and another of said annular grooves extends in said second component.

18. The combination as claimed in claim 9, wherein said one of said components is an underplate of a slide gate nozzle having a tapered connecting portion, the other of said components is a discharge pipe fitted over said tapered connection portion, and said spring ring has a frusto-conical inner peripheral surface.

19. The combination as claimed in claim 9, wherein said one of said components has at least one through-hole extending radially therethrough so as to be open to the interior thereof, the other of said components has at least one through-hole extending radially therethrough, said components being rotatable relative to one another between positions at which the at least one through-holes of said components are respectively in and out of alignment with one another, and wherein two of the spaced apart annular grooves are disposed on opposite axial sides of said at least one through-holes.

20. The combination as claimed in claim 9, wherein the end portions of said spring ring are overlapped and superposed in the axial direction of said spring ring.

* * * * *